United States Patent [19]

Bridges et al.

[11] Patent Number: 5,070,533

[45] Date of Patent: Dec. 3, 1991

[54] ROBUST ELECTRICAL HEATING SYSTEMS FOR MINERAL WELLS

[75] Inventors: Jack E. Bridges, Park Ridge; Thomas J. Bajzek, Wood Dale; Kenneth E. Hofer, Chicago Ridge, all of Ill.; Homer L. Spencer, Calgary, Canada; Larry G. Smith, Calgary, Canada; Vincent R. Young, Calgary, Canada

[73] Assignee: Uentech Corporation, Tulsa, Okla.

[21] Appl. No.: 610,080

[22] Filed: Nov. 7, 1990

[51] Int. Cl.[5] ..... E21B 7/15; E21B 36/04; H05B 3/02; H05B 3/78

[52] U.S. Cl. ..... 392/301; 166/60

[58] Field of Search ..... 392/301, 305-306; 166/57-60, 248; 175/16-17

[56] References Cited

U.S. PATENT DOCUMENTS

| | | | |
|---|---|---|---|
| 2,276,833 | 3/1942 | Germain | 392/301 |
| 3,113,623 | 12/1963 | Krueger | 166/59 |
| 3,420,301 | 1/1969 | Riley et al. | 392/301 |
| 4,012,868 | 5/1991 | Bridges | 166/60 |
| 4,570,715 | 2/1986 | Van Muers et al. | 392/301 |
| 4,790,375 | 12/1988 | Bridges et al. | 392/301 |

*Primary Examiner*—Bruce A. Reynolds

*Assistant Examiner*—John A. Jeffery

*Attorney, Agent, or Firm*—Kinzer, Plyer, Dorn, McEachran & Jambor

[57] ABSTRACT

Electrical heating system for mineral wells, particularly oil wells, in which the reservoir or "pay zone" is heat stimulated or some well components (e.g., the tubing) are heated, or both, by electrical power supplied to a multi-perforate electrode have the operating efficiency enhanced by effectively terminating the heating electrode, at both its top and bottom, at a distance inwardly of the pay zone equal to at least three times the diameter of the well casing. In some systems the electrical power connection to the main heating electrode is made through a section of the production tubing of the well, with an electrical contactor interconnecting the tubing and the electrode in the level of the pay zone; these systems also provide electrical isolation, within critical height limits, for the production tubing and the pump rod. Delivery of electrical power downhole of the well may be accomplished through an electrical cable, which may or may not be appropriately armored. Specific electrode construction combine conductive and insulating materials to counteract galvanic corrosion while maintaining mechanical strength.

52 Claims, 6 Drawing Sheets

46
42
41
40
34
36
45
20
22
21
39A
43
47
44
37A
44
23
26A
31
27
39B
52A
37B
49
H1=3D1
48
51A
55
39C
PAY ZONE 24
29
38
P
28
51B
H2=3D1
37C
52B
D2
25
D1
26B
27
21

139E
139D
141
140
120
144
134
139A
142
136
126E
126D
126A
137A

Fig. 8.
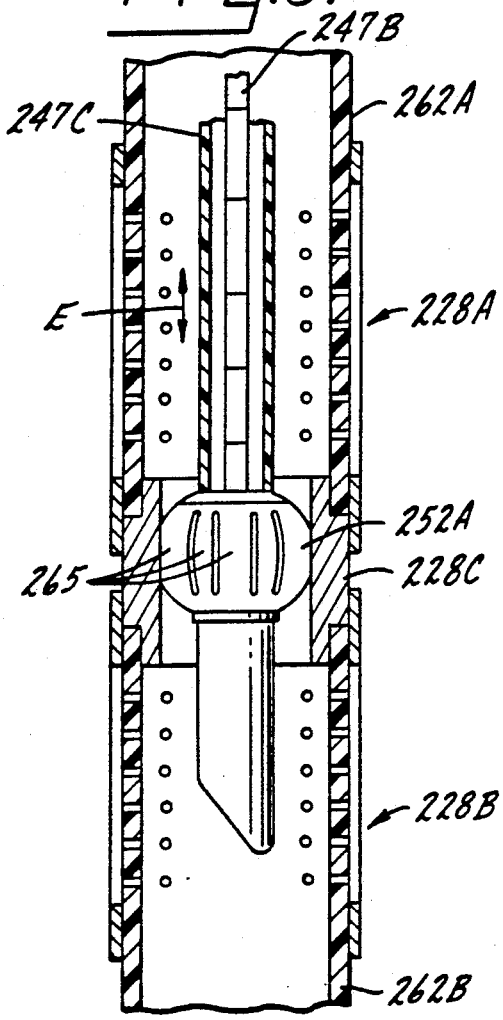
Fig. 9.
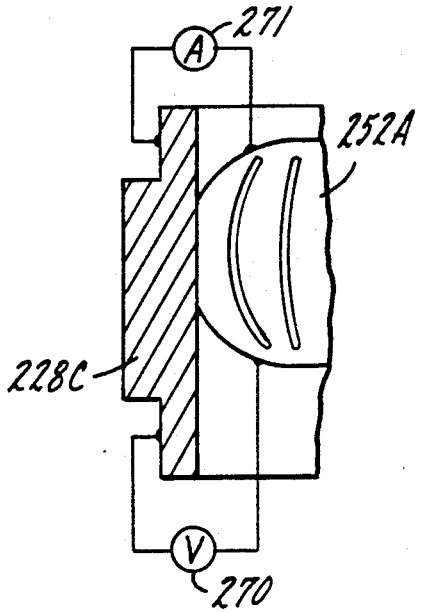
Fig. 10.
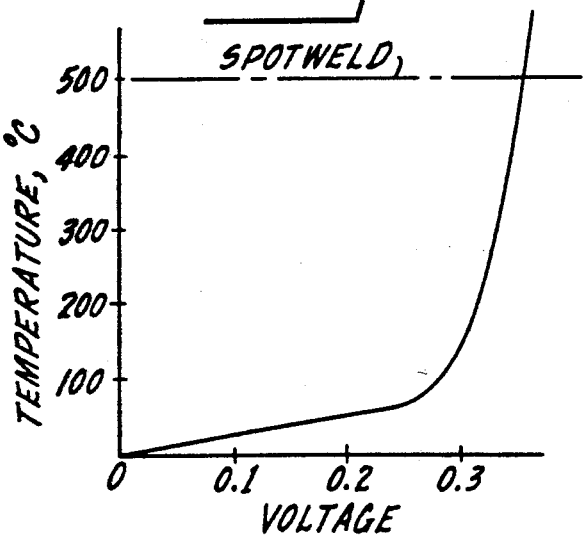
Fig. 11A.
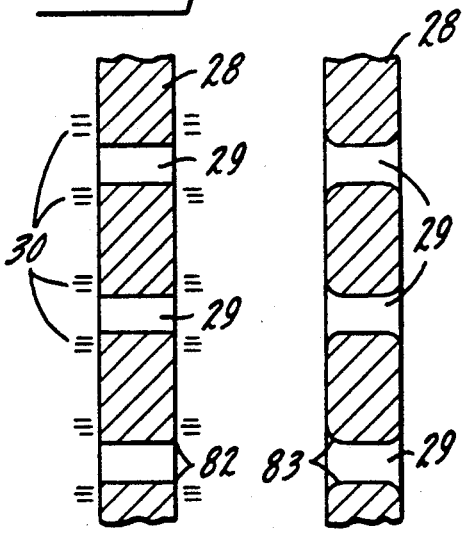
Fig. 11B.

ROBUST ELECTRICAL HEATING SYSTEMS FOR MINERAL WELLS

BACKGROUND OF THE INVENTION

There are several reasons to provide an electrical heating system in a mineral well, particularly in an oil well. Thus, for many petroleum deposits, the liquid sought is relatively viscous but is subject to stimulation for better flow by heating, particularly electrical heating. In other instances, the petroleum may contain constituents that would be solids or near solids at ordinary room temperatures; these constituents include paraffins and asphalts. Petroleum containing substantia' quantities of such constituents may flow acceptably at the temperatures encountered in their natural reservoirs, but tend to precipitate as the fluid cools on its way through the well toward the earth's surface. In these circumstances, it may be desirable or necessary to heat some well components, particularly the production tubing through which the petroleum flows to the surface. Of course, it is not unusual for an individual oil well to have characteristics such that both forms of heating are either necessary or desirable.

While electrical heating systems for mineral wells have been proposed that function to accomplish both purposes, such systems have often been relatively inefficient so that electrical heating, either for reservoir stimulation or to preclude precipitation in well operation, is economically unacceptable. In the systems of the present invention, this problem is effectively minimized by appropriate selection of the size, location, and construction of the principal heating electrode employed for reservoir stimulation and of other components employed in the heating system, including particularly electrical and thermal isolation elements. The technique employed to deliver electrical power to the downhole portion of the well where it is particularly needed is also materially improved in many instances, especially for reservoir stimulation.

SUMMARY OF THE INVENTION

It is a principal object of the present invention, therefore, to provide novel electrical well heating systems for mineral wells that improve the efficiency of the heating operation, whether utilized for reservoir stimulation or for heating components of the well itself. This object is realized in part by preventing excessive power dissipation in the annulus between the pump rod and the tubing in the annulus between the tubing and the casing; it is also realized in part by minimizing other parasitic power losses between the main electrode and adjacent portions of the well casing.

Another object of the invention is to provide a new and improved electrical heating system for a mineral well, particularly an oil well, that can be utilized equally effectively in a well having a grounded wellhead or in a well having a wellhead that is electrically "hot".

Another object of the invention is to provide a new and improved electrical heating system for oil wells or other wells that effectively limits localized temperature increases and mechanical stresses at downhole locations. An additional object of the invention is to provide robust, corrosion resistant downhole electrical heating electrodes that preclude ingress of sand to a mineral well without undue inhibition of fluid inflow.

A object of the invention is to provide a new and improved high efficiency electrical heating system for a mineral well, such as an oil well, that is simple and inexpensive in construction, that can be utilized in conjunction with known conventional oil well drilling and oil well completion apparatus, and that provides the inherent long life that is a requisite of an effective and efficient well.

Accordingly, in one aspect the invention relates to an electrical heating system for a mineral well (e.g., an oil well) comprising a conductive metal casing of given diameter D1 disposed as a liner within a well bore that extends into the earth through a pay zone (reservoir) containing the desired mineral liquid; the casing comprises two sections separated by a gap within the pay zone. A production tubing of given diameter D2, such that $D2<D1$, extends longitudinally through the casing in spaced relation thereto. A multi-perforate heating electrode, comprising a cylinder having a diameter of about D1, is positioned in the gap in the pay zone as a part of the casing, one end of the electrode being effectively terminated inwardly of the pay zone by a distance of at least about 3D1 from the corresponding outer limit of the pay zone. There are two non-conductive isolator cylinders, each having a diameter of about D1, each isolator cylinder mechanically connecting the electrode to the casing to afford a complete casing structure through the pay zone portion of the well bore. Electrical power connection means are provided for applying electrical power to the electrode.

In another aspect the invention relates to an electrical heating system for a mineral well, such as an oil well, comprising a well bore that extends into the earth through a pay zone containing the desired mineral liquid and a liner suspended within a downhole portion of the well bore, the liner extending from a location above the pay zone to a location at least as low as the bottom of the pay zone, the liner being formed principally of a fiber reinforced non-conductive pipe having a diameter D5. A multi-perforate heating electrode of cylindrical configuration, having a diameter of about D5, is positioned in and forms a part of the liner, in the pay zone, one conductive end rim of the electrode being disposed inwardly of the pay zone by a distance of at least about 3D5 from the corresponding outer limit of the pay zone; electrical power connection means are provided for applying electrical power to the electrode.

In yet another aspect, the invention relates to a downhole heating electrode assembly for an electrical heating system in a mineral well, such as an oil well, comprising a cylindrical conductive first electrode member positioned within the mineral well in a pay zone, the first electrode member having at least a limited number of apertures therethrough. A cylindrical insulator second electrode member is disposed within the first electrode member; it includes a multiplicity of perforations therethrough, at least some of the perforations in the insulator member being aligned with the apertures in the conductive first electrode member to permit ingress of fluid from the pay zone of the well to the interior of the cylindrical insulator member. Electrical contactor means extend from the conductive first electrode member through the insulator member to the interior of the insulator member, for applying electrical power to the conductive electrode member.

BRIEF DESCRIPTION OF THE DRAWINGS

FIG. 8 is a simplified sectional elevation view of a specific construction for use in a portion of the system of FIG. 7;

FIG. 9 is an explanatory illustration for a part of the system of FIG. 8;

FIG. 10 is a curve showing electrical relationships in the systems of FIGS. 7-9;

FIGS. 11A and 11B are detail views, on an enlarged scale, used to explain the effects of galvanic corrosion on a well heating electrode;

DESCRIPTION OF THE PREFERRED EMBODIMENTS

Figure 1:
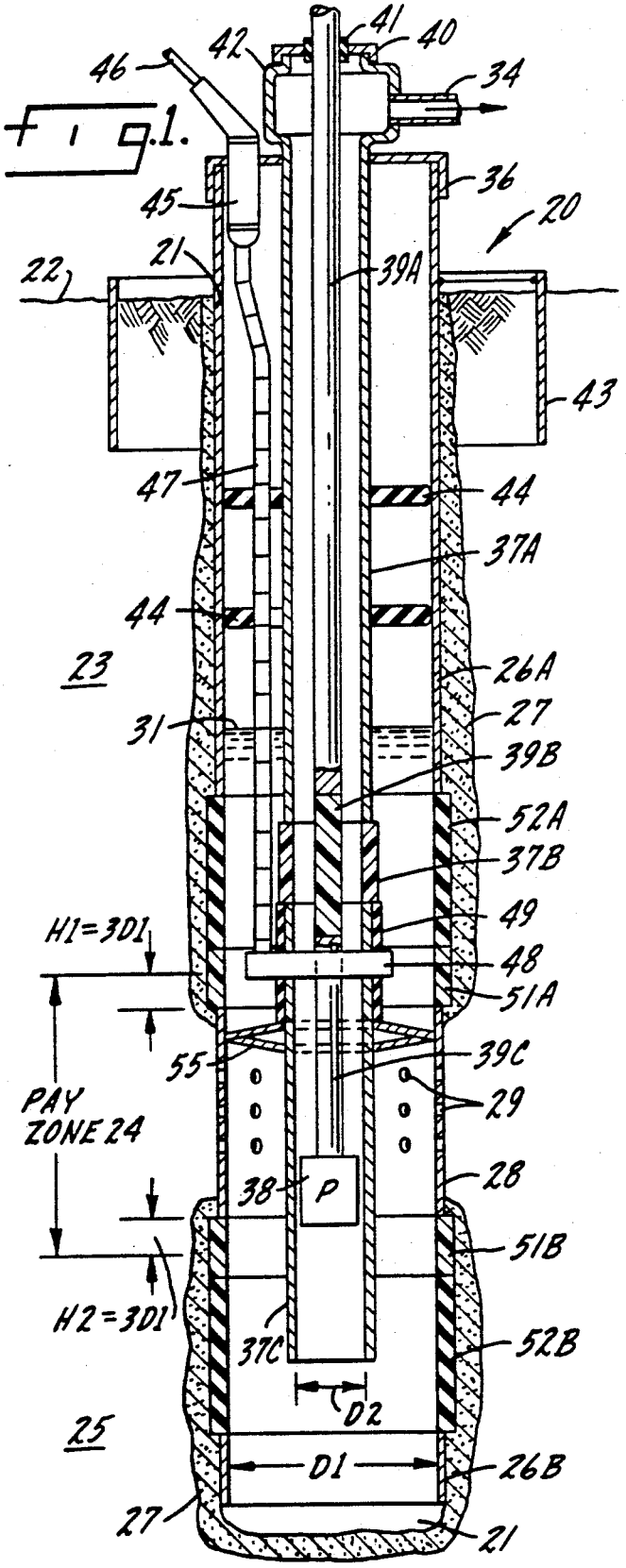
FIG. 1 is a simplified sectional elevation view of a mineral well equipped with a heating system constructed in accordance with one embodiment of the present invention, with the height dimensions greatly condensed.

FIG. 1 illustrates a liquid mineral well 20, usually an oil well, equipped with an electrical heating system comprising a grounded wellhead embodiment of the present invention. Well 20 comprises a well bore 21 extending downwardly from a surface 22 through an extensive overburden 23 that may include a variety of different formations. Bore 21 of well 20 continues downwardly through a mineral (oil) deposit or "pay zone" 24 and into an underburden 25. Well 20 is utilized to draw a mineral fluid, in this instance petroleum, from the deposit 24, and to pump that fluid up to surface 22.

An electrically conductive metal casing comprising an upper section 26A and a lower section 26B lines a major part of well bore 21. The upper casing section 26A extends downwardly from surface 22. Cement 27 may be provided around the outside of the well casing. In well 20, the lower casing section 26B is shown as projecting down almost to the bottom of well bore 21; a limited portion of the well bore may extend beyond the bottom of casing section 26B. In FIG. 1 it will be recognized that all vertical dimensions are greatly foreshortened.

Between the two well casing sections 26A and 26B, in alignment with pay zone 24, there is a cylindrical conductive electrode 28 that may be formed as a multi-perforate section of the same metal casing pipe as sections 26A and 26B. The perforations or apertures 29 (electrode 28 may be a screen) admit the mineral fluid (petroleum) from deposit 24 into the interior of the well casing. Apertures 29 may be small enough to block entry of sand into the well. Petroleum may accumulate within the well casing, up to a level well above deposit 24, as indicated at 31. Level 31 may be as much as 500 to 800 meters above the top of pay zone 24, depending on the pressure of the liquid in the deposit. Casing sections 26A and 26B may be made of conventional carbon steel pipe with an internal diameter D1 of about 7 inches (18 cm); the same kind of pipe can be used for the heating electrode 28. Other electrode constructions are described hereinafter. At the top of well 20, the casing section 26A is covered by a wellhead cap 36.

Well 20, FIG. 1, further comprises an elongated production tubing, including three successive tubing portions 37A, 37B and 37C that extend downwardly within well 20. The bottom tubing portion 37C encompasses a pump 38 and projects down below pay zone 24. The upper and lower portions 37A and 37C of the production tubing are conductive metal pipe; the intermediate section 37B is non-conductive, both electrically and thermally. Resin pipe reinformed with glass fibers or other fibers can be used for portion 37B of the production tubing; such tubing is available with adequate strength and non-conductivity characteristics. Sections 37A, 37B and 37C of the production tubing are shown as abutting each other; interconnections are not illustrated. It will be recognized that appropriate couplings must be provided to join these tubing sections. Conventional threaded connections can be employed, or flanged connections may be used. A preferred coupling construction is described in connection with FIGS. 5 and 6.

From the top of well 20 a pump rod or plunger 39A projects downwardly into production tubing 37A through a bushing or packing element 41 in a wellhead cap 40 that terminates tubing 37A. Rod 39A may be mechanically connected, by an electrical thermal insulator rod section 39B and a lower pump rod section 39C, to the conventional pumping mechanism generally indicated at 38. In some systems the isolator rod section 39B may be unnecessary.

In the preferred construction for well 20, production tubing sections 37A and 37C may be conventional carbon steel tubing. In a typical well, the production tubing 37A-37C may have an inside diameter D2 of approximately two inches (five cm). The overall length of the production tubing, of course, is dependent upon the depth of well bore 21 and is subject to wide variation. Thus, the total length for tubing 37A-37C may be as short as 200 meters or it may be 1500 meters, 3000 meters, or even longer.

At the top of well 20 there is a surface casing 43 that encompasses the upper casing section 26A. The surface casing is usually ordinary steel pipe. It extends down into overburden 23 from surface 22 and affords a surface water barrier and an electrical ground for the well. A fluid outlet conduit 34 extends away from an enlarged wellhead chamber 42 at the top of the production tubing; conduit 34 is used to convey the oil from well 20 to storage or to a liquid transport system. In well 20, a series of annular mechanical spacers 44 position the production tubing section 37A approximately coaxially within the well section casing 26A, maintaining the two in spaced relation to each other. However, the annular spacer members 44 should not afford a fluid-tight seal at any point; rather, they should allow gas to pass upwardly through the well casing, around the outside of tubing 37, so that the gas can be drawn off at the top of the well. Similar spacers or "centralizers" (not shown) are preferably provided farther down in well 20. In some systems spacers 44 are electrical insulators; in others, spacers 44 are of metal. The choice depends on what parts of well 20 require heating.

As thus far described, apart from the insulating sections and electrode structures described more fully hereinafter, well 20 is essentially conventional in construction. Its operation will be readily understood by those persons involved in the mineral well art, whether the wells are used to produce liquid petroleum, natural gas, or some other mineral fluid. Well 20, however, is equipped with an electrical heating system, and features of that heating system are the subject of the present invention.

The well heating system illustrated in FIG. 1 includes an electrical power source (not shown), preferably an alternating current source, that is connected to the well 20 by an external power cable 46 and a wellhead power feedthrough 45. Members 34, 36, 37A, 43 and 45 are all maintained in effective electrical contact with each other, and all are effectively grounded. Thus, the wellhead or superstructure for well 20 is all electrically grounded and presents no electrical danger to workmen or others at the well site. This is a "cool" wellhead.

The electrical heating system for well 20 includes an internal electrical power cable 47 that extends down through the upper section 26A of the well casing. The upper end of power cable 47 is connected to external cable 46 through the electrical power feedthrough device 45. The lower end of power cable 47 extends to a connector subassembly 48 that electrically terminates the cable, connecting it electrically to the lower conductive production tubing portion 37C. In the construction for well 20 that is illustrated in FIG. 1, the electrical connector subassembly 48 is located near the top boundary of the deposit or pay zone 24. Above and below connector 48, the upper part of this portion 37C of the production tubing is preferably covered by a thermal and electrical insulator coating 49, except where electrical contact is made to tubing portion 37C (not shown). Indeed, in the preferred construction the electrical connector subassembly 48 itself should be covered with electrical and thermal insulator material, usually in the form of a coating, so that it is not exposed to the liquid within the annulus between the production tubing and the well casing. Connector assembly 48 can be a commercially available device, requiring little or no modification. A contactor 55 affords an electrical connection from tubing portion 37C to electrode 28. Contactor 55 may also be of conventional construction.

The electrical heating system of well 20, to operate efficiently, must isolate the pay zone components, particularly electrode 28 and production tubing section 37C, from other components of the well structure. This also usually applies to the lower pump rod section 39C. In part, the electrical and thermal isolation required has already been described, including the central production tubing portion 37B and the coating 49 on the upper portion of production tubing portion 37C, except where tubing 37C engages connector sub 48. As previously noted, there is an insulator/isolator section 39B in the pump rod. Tubing portion 37B and rod section 39B each should have a minimum height of one meter; a height of more than three meters is preferred. Isolation of the upper and lower sections 26A and 26B of the well casing from the electrode 28 is, if anything, even more important.

Thus, there is a high temperature insulator cylinder 51A mounted on the top of electrode 28. Cylinder 51A should have a minimum height of one meter; a height of over three meters is preferred. Immediately above cylinder 51A there is an additional thermally and electrically non-conductive insulator cylinder 52A that should be much longer than cylinder 51A. These two cylinders 51A and 52A have internal diameters approximately the same as the casing diameter D1 which, indeed, is also the approximate internal diameter of electrode 28. A similar construction is repeated below electrode 28, comprising a high temperature insulator cylinder 51B that is extended much further by an additional non-conductive cylinder 52B. Members 51B and 52B can be of unitary construction, as can also be done with isolator cylinders 51A and 52B. They are shown as having two-piece construction because high temperature resistance is essential immediately adjacent the main heating electrode 28 but is not so critical farther away. Moreover, an alternative construction may be utilized for isolator cylinders 51A and 52A as described in connection with FIGS. 3 and 4.

The top of electrode 28 should be located below the top of pay zone 24; that is, the upper rim of the electrode (or bottom of insulator 51A) should be positioned so that it is at least three diameters inwardly of the pay zone. Thus, H1 should be at least equal to and preferably considerably greater than 3D1. Similarly, the bottom of electrode 28 should be up in the pay zone, so that H2 is at least 3D1 and preferably more.

The height of the electrical isolator tubing section 37B can also be critical to efficient operation of the heating system of well 20. The tubular isolator 37B should have a height of at least three meters. A better system is provided if the height of the tubular isolator member 37B is made sufficient so that no more than ten percent of the electrical power in the heating system is dissipated in the annulus between the heating electrode 28 and the upper section of the casing 26A in well 20. This same dissipation criterion should be observed in determining the overall height of the casing isolation cylinders 51A and 52A. Furthermore, the height of cylinders 51B and 52B is preferably made great enough so that no more than ten percent of the electrical power in the heating system is dissipated in the annulus between the heating electrode 28 and the lower section of the casing, below the pay zone.

In FIG. 1, as illustrated, the electrical connector subassembly 48 is located close to the top limit of pay zone 24. With this arrangement, the heating system is employed almost exclusively for stimulation of flow in the pay zone. That is, little or no heat is supplied to the upper components of well 20, particularly tubing portion 37A and casing section 26A. In some wells, however, as previously noted, it may be desirable to afford substantial heating in upper portions of the well in order to avoid precipitation of paraffins or asphalts in the top part of the well. To provide for appreciable heating in the upper portion of the well, connector 48 can be moved upwardly to a substantially higher level. Of course, this means that the electrical isolation components, particularly rod section 39B and tubing section 37B, must also be moved upwardly to the same extent. In this way, the heating system of well 20 can be adapted to heating of part of the production tubing as well as to reservoir stimulation.

Figure 2:
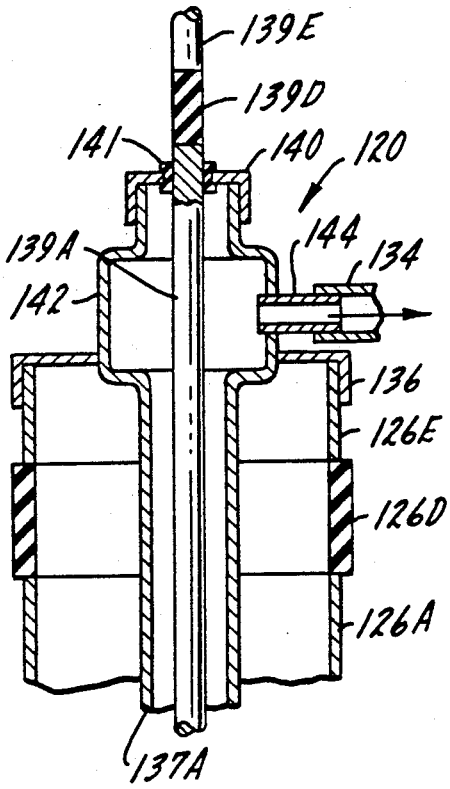
FIG. 2 is a simplified sectional elevation view of the top portion of a mineral well, similar to FIG. 1, having a heating system constructed in accordance with a modification of the invention.

FIG. 2 illustrates a "hot wellhead" modification of the heating system shown for well 20, FIG. 1. In well 120, FIG. 2, the upper end of a steel pipe casing section 126A is extended by an electrical and thermal insulator cylinder 126D that is in turn surmounted by another conductive casing section 126E. Couplings as described in connection with FIGS. 5 and 6 can be used for pipe 126D. A cap 136 fits onto casing section 126E.

In this construction an upper production tubing section 137A leads into an enlarged chamber 142 from which an outlet conduit 134 leads to a storage or transport system. In this instance, however, an electrical and thermal insulator tube 144 is used to isolate conduit 134 from chamber 142 and production tubing 137A, so that the conduit 134 can be grounded. As before, there is a wellhead cap 140 at the top of the well 120, with a bushing 141 down through which a pump rod 139A extends. In this instance, the pump rod 139A has an insulator section 139D at the upper end of the rod, which is then extended further by an additional pump rod section 139E.

The modification shown in FIG. 2 functions the same way as the system of FIG. 1. The significant difference is that the apparatus of FIG. 2 is an electrically "hot" wellhead instead of the grounded or "cool" wellhead of the first figure. In all other respects, the operation can be and should be the same, and the same basic downhole structural requirements apply.

Special attention to the downhole well components is needed to avert failure of electrical insulation due to excessive localized heating and the resultant temperature rise. Such localized heating may occur near the tips (top and bottom edges or rims) of the downhole heating electrode (e.g., electrode 28 in FIG. 1), whether or not the electrode edges are both in the oil deposit 24 or the top edge is above the deposit itself in the overburden 23 or the bottom rim is below the deposit in the underburden 25. Electrons, being of like charge, repel each other; as a consequence, because the electrical potential of electrode 28 is virtually the same throughout, the electrical charge accumulates near the extremities of the electrode. This increases the charge density, particularly at the top and at the bottom of the electrode; consequently, the current density is highest at the extremities of the electrode or near any sharp corners or edges (rims) of the electrode. This excess current density has at least two deleterious effects: (1) excessive heating near the electrode extremities, and (2) excessive galvanic erosion of the metal near the electrode edges or rims.

Figure 3:
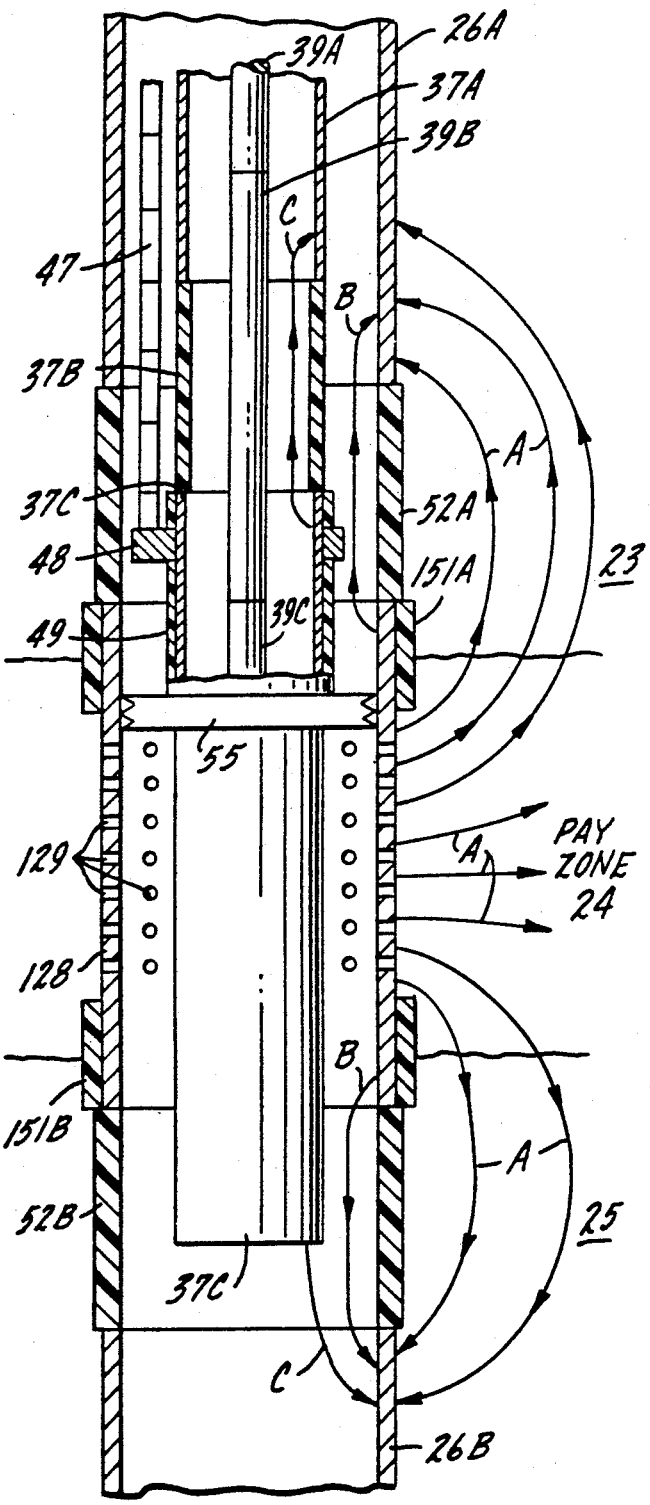
FIG. 3 is a simplified sectional view, similar to a part of FIG. 1 but on an enlarged scale, used to explain some features of the invention.
Figure 4:
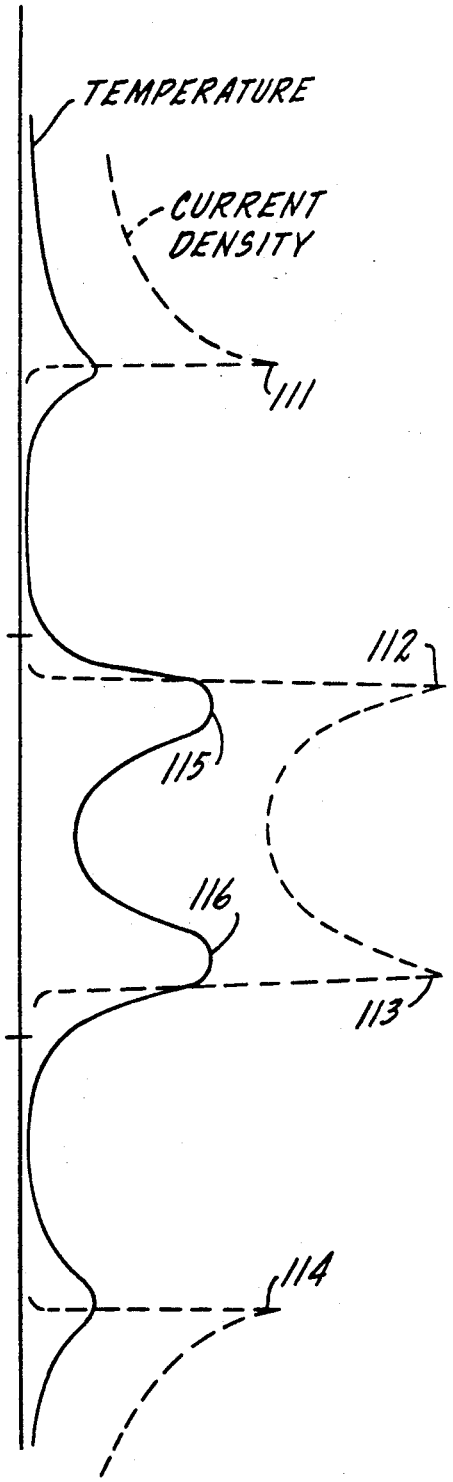
FIG. 4 is a chart of temperature and current density for FIG. 3.

FIGS. 3 and 4 illustrate some aspects of this excessive current density situation. In FIG. 3 the main heating electrode 128 is similar to electrode 28 of FIG. 1, constituting a section of the conductive steel well casing with multiple perforations 129; only a few of the perforations are shown. Current density and temperature rise difficulties are the same for both electrodes. Electrical current is carried to the illustrated downhole portion of the well, FIG. 3, by means of the insulated cable 47 which is attached to and electrically connected to the connector subassembly 48. From connector sub 48 the heating current goes through the upper part of tubing portion 37C to the contactor 55. The heating current then is distributed across the electrode 128 and, for the most part, flows along the pathways A, into pay zone 24 and back to casing sections 26A and 26B, which serve as the circuit returns (ground) in the illustrated system. In the case of current that flows along the pathways A, excessive current flows near the upper and lower rims of the electrode 128, particularly the upper rim, due to the aforementioned charge accumulation phenomenon FIG. 4 shows the current density as a function of height along the electrode 128 and the other well components illustrated in FIG. 3.

In addition to the current density peaking at the upper and lower ends of electrode 128, it also peaks near the ends of the adjacent conductive sections of the well casing, assuming the casing is used as a ground as described. Thus, with a grounded casing, as shown in FIG. 3, the current density peaks are as shown at 111, 112, 113, and 114 in FIG. 4. In the event that the well casing is not used as a ground, current density peaks appear at the tips of the buried electrodes (not shown) which are used for the heating current return (ground). FIG. 4 illustrates this type of peaking conceptually; the distribution between the current densities associated with the different positions downhole of the well may vary widely, depending upon a number of factors such as the conductivity of pay zone 24, overburden 23, and underburden 25, and the size of the electrode(s) and casing.

The high current densities represented by peaks 112 and 113 causes excess heating near the ends of electrode 128. This excessive heating is mitigated to some extent by the convective effects of the fluid flow through the production tubing 37C–37A, and by thermal diffusion. However, in many cases the upper part of the electrode 128 may be located in an impermeable zone, thereby minimizing the benefits of convection cooling. As seen in FIG. 4, in the temperature curve, there are considerable temperature rises 115 and 116, well over the average temperature, near the ends of electrode 128. Therefore, the portion of the well shown in FIG. 3, and particularly the insulators 151A and 151B, must be able to withstand the peak temperatures to which they are subjected.

In FIG. 3, the high temperature insulator cylinders 51A and 51B of FIG. 1 are shown replaced by external layers 151A and 151B of high temperature insulation on the outer rim portions of electrode 128. The construction shown in FIG. 3 is preferable, for reasons of mechanical strength, though both are viable. The use of high temperature insulation over a steel pipe, as with members 151A and 151B in FIG. 3, allows further mechanical strength that would not otherwise be possible with only fiber reinforced plastic pipe. Furthermore, in order to withstand the mechanical stresses associated with the downhole well completion, such as associated with fracing, the high-temperature plastic must be reinforced by successive layers of fiberglass. Thus, temperature withstand capabilities in excess of 300° F. are desired, along with the requisite mechanical properties.

FIG. 3 illustrates further basic problems associated with downhole well completion, utilizing electrical heating, and particularly constructions that are effective to minimize the temperature losses and parasitic losses associated with downhole electrical heating systems. In FIG. 3, in addition to the working current pathways A, there are further current pathways B in the well casing.

Contactor 55 and electrode 128 may be at an electrical potential of some 500 to 1,000 volts with respect to the casing section 26A and tubing portion 37A. Thus, the electrical heating current not only flows through pathways A to the casing sections 26A and 26B, but it also flows through pathways B because of the finite conductivity of the fluids in the annular space between the tubing sections 37A–37C and the casing. The upper current pathways B leave the metallic part of electrode 128 on the inside of insulator 151A and flow upwardly to the lower portion of casing 26A. This represents a parasitic loss of power and needs to be controlled to prevent excess power consumption and excess temperature rise in the fluids in the lower part of the well bore. Such excess rise could cause deterioration in the mechanical properties of the reinforced fiberglass casing 52A. The same situation exists with the lower current paths B from the bottom rim of electrode 128 to casing section 26B, posing an excess heat problem for insulator casing cylinder 52B. Another set of parasitic current pathways C exist between the cable connection point at the top of tubing section 37C and the upper portion 37A of the tubing and from the bottom of tubing 37C to casing section 26B. Again, the same criteria apply; that is, the pathways C should not represent excessive parasitic power consumption and also should not rise to an excessively high temperature so as to deteriorate the insulation, in this instance the insulator/isolator tubing portion 37B and, again, insulator 52B.

Where high temperature insulation is not used, a maximum safe power dissipation along the casing or the tubing is of the order of 300 watts per meter or less. This, of course, assumes most of the power is dissipated by thermal conduction and that the casing (or tubing) is a material that is a reasonably good thermal conductor. However, if the casing is located in some formations, such as certain evaporite type deposits, the thermal conductivity may be much less and may require much lower maximum operating power dissipation levels.

Power dissipation can also be controlled, in part, by fluid convection, particularly along pathways C. Along pathways B, there is little or no fluid convection except from some turbulence created by gas flow. In any event, considerable safety factors are possible by shutting down the electrical heating system in the event that fluid flow stops, and that control measure should be applicable at all times.

Figure 6:
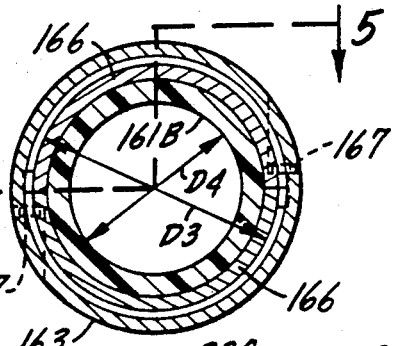
FIG. 6 is a transverse sectional view of the coupling of FIG. 5, taken approximately along line 6—6 in FIG. 5.
Figure 5:
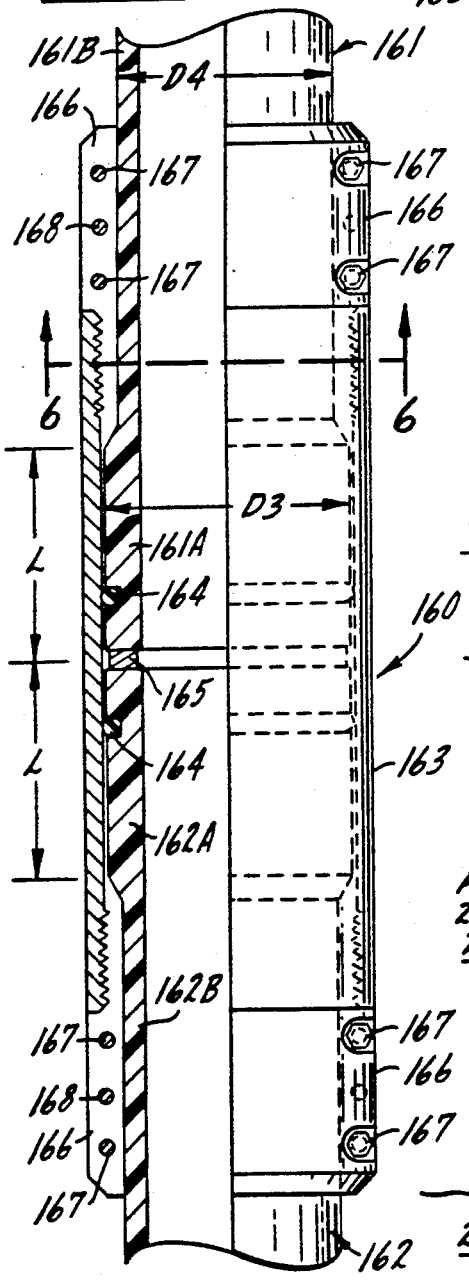
FIG. 5 is a half-sectional view of a split collar insulator pipe coupling used in some embodiments of the invention, taken approximately along line 5—5 in FIG. 6.

FIGS. 5 and 6 illustrate an improved split collar pipe coupling 160 for use in connecting the fiber reinforced plastic pipes employed in various electrical heating systems according to the invention. Coupling 160 entails the use of a split collar construction that provides greater mechanical strength than typical conventional coupler designs, in which the threads usually represent the weakest link. Flange couplers of conventional types also often cannot provide the required strength. The split collar pipe coupling 160, however, provides the appropriate mechanical strength to permit effective use of electrical and thermal isolation pipes.

The split collar coupling 160 shown in FIGS. 5 and 6 connects two fiber reinforced plastic (FRP) pipe segments 161 and 162 to each other end-to-end. The adjacent ends 161 A and 162A of the two insulator pipes are made appreciably thicker than their main portions 161B and 162B. Thus, pipe section 161 has a given outside diameter D3 for a predetermined length L from the end adjacent pipe section 162 and has a smaller diameter D4 for at least a substantial distance beyond length L. Pipe section 162 has the same configuration. The thick end of each of the pipe sections 161 and 162 includes an O-ring 164.

A cylindrical metal coupler pipe 163 having internally threaded ends is slipped over the two abutting ends 161A, 162A of the fiber reinforced plastic pipe sections 161 and 162; there may be a washer 165 between them. The threaded ends of coupling pipe 163 project over the diameter D4 parts of insulator pipe segments 161, 162. Two split collar members 166 are then positioned over the D4 diameter portion of each of the FRP pipes, bolted together by bolts 167 (dowels 168 may also be used) to form complete cylindrical collars, and then screwed into the threaded ends of metal pipe 163 to complete the split collar pipe coupling 160. The O-rings 164 (and washer 165) provide the requisite fluid-tight seal. The coupling construction is stronger and more durable than conventional constructions.

Figure 7:
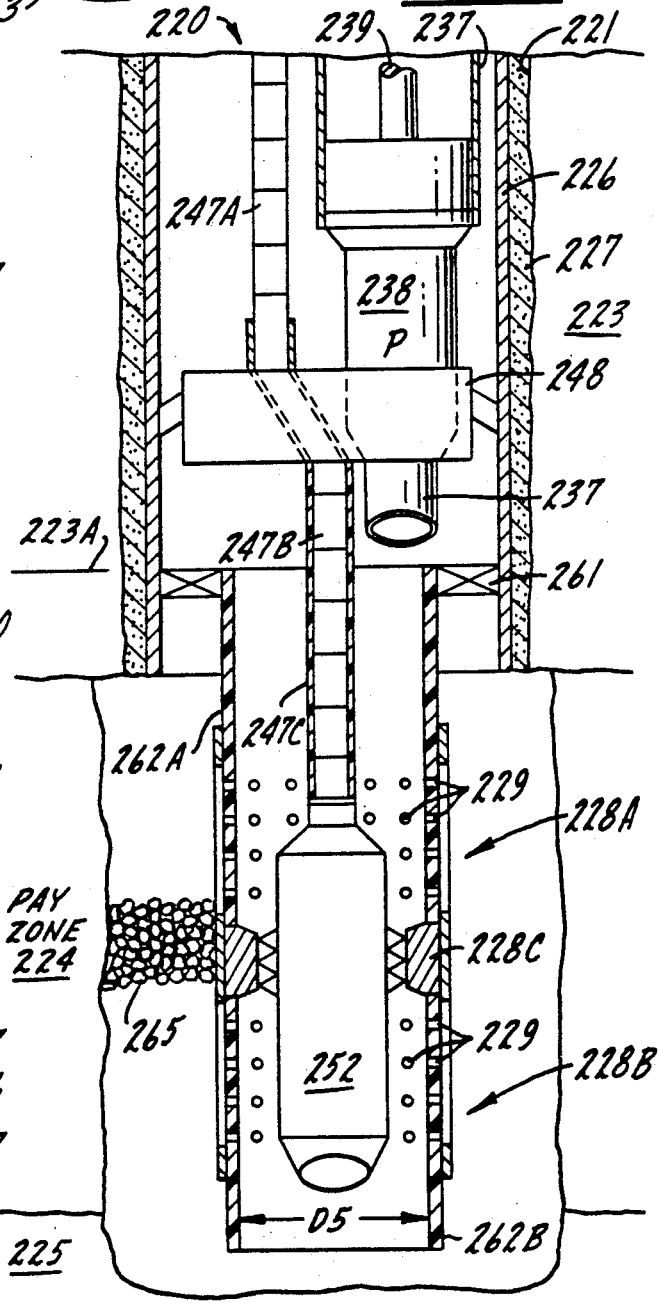
FIG. 7 is a simplified sectional view, similar to a part of FIG. 1, of another embodiment of the invention.

For completion of an "open hole" well the problems are similar to those described above for "cased hole" completions. One of the objects of an "open hole" heating system, such as the system illustrated in FIGS. 7–9, is to minimize the excessive heating and parasitic power consumption effects associated with parasitic current paths A (FIG. 3) wherein the current flows from the electrode to the lower part of the set casing, and also from the electrode up through the collected fluids to the casing and to gravel pack extensions. Further, in an "open hole" well, the same enhancement of current density occurs at the tips of the electrode and bottom of the casing as illustrated in FIG. 3. However, additional requirements should be met for open hole completions.

For an "open hole" well 220, a borehole 221 is initially drilled through the overburden 223 to about the top of the producing formation of interest, the "pay zone" 224; see FIG. 7. A production casing 226 is conventionally set in the borehole 221, with cement 227. The borehole is then drilled down further, into the deposit 224 and beyond, into the underburden 225, usually at an enlarged diameter. During the extension of the borehole, high density "mud" is utilized to preclude inward collapse of the borehole. The weight of the mud is adjusted to prevent ingress of reservoir fluids into the borehole and to prevent collapse of the borehole in the incompetent portion of the target reservoir, the pay zone 224.

The next step is to set in a liner system as illustrated by the components at depths below level 223A, FIG. 7. This liner system includes a conventional gravel pack packer 261 at level 223A and a gravel pack extension liner 262A; two electrical heating electrodes 228A and 228B connected by a collet 228C lead down to another liner section 262B. Liners 262A and 262B are both electrical insulators, preferably FRP pipe having a diameter D5. Once the liner components are in place, the system can be gravel packed. The gravel pack 265 (shown partially) precludes ingress of larger particles of sand and stabilizes the position of the liner and electrode assembly members.

The next step is to introduce a contactor 252, which makes electrical contact to the contact cylinder or collet 228C between the two heating electrodes 228A and 228B. The contactor 252 is connected to a power cable 247B which is housed in a fiberglass or other insulated cable container, shown as an FRP pipe 247C. The cable container 247C also supports the cable section 247B, from a cable connector subassembly 248 anchored in casing 226. The cable connector assembly 248 also terminates the production tubing 237 of the well. A commercially available cable 247A, preferably an armored cable, goes upwardly in well 220, above the cable connector assembly.

The components below depth 223A in the well 220 of FIG. 7 must withstand the rigors of the gravel pack system. As a result of the gravel packing, considerable mechanical stresses are placed upon the fiber-reinforced plastic liner pipe sections 262A, 262B and on the electrode assembly 228A-228C. During operation of the well, the temperature will rise in the deposit (pay zone 224) due to electrical heating. This will cause expansion of the system components and could cause collapse of the liner 262A, 262B. This is prevented by use of a gravel pack extension subassembly, particularly packer 261, that permits at least some upward shifting of the gravel pack liner. However, in practice, the liner itself may be so constrained by the gravel pack that this is not possible. As a result, considerable stress due to thermal conditions may be anticipated in the liner, particularly in pipes 262A, 262B.

In addition, the fiberglass cable container 247C may experience severe stress owing to a variety of causes, such as shifting of the gravel pack and of the electrode and liner system. Thus, contactor 252 must be able to shift vertically in casing 226 in response to reasonable downward or upward forces applied via the fiberglass cable container 247C.

FIG. 8 illustrates a collet and contactor construction, for a contactor 252A, liner sections 262A and 262B, and electrode assembly 228A-228C, usable in FIG. 7. The contactor 252A consists of a series of resilient compressible, conductive, strap-like sections 265 which, when contactor 252A enters collet 228C, are compressed to make firm frictional contact with the inner wall of the collet. The outward radial force which the contactor springs 265 exert in the collet 228C is controllable by the design and construction of the contactor. However, a design compromise is needed because if the spring force is too great the contactor will not move within the collet when a reasonable upward or downward force (arrows E) is applied through the FRP cable container 247C. On the other hand, if springs 265 are too loose, then good electrical contact is not established between contactor 252A and collet 228C, with the result that arcing or welding of the contactor to the collet may occur, freezing the contactor in the collet with a possibility of damage to the liner 262A or to cable container 247C due to unanticipated thermal expansion or during the removal of the contactor in the course of work-over of the well.

The design criterion for the contactor-collet construction, FIG. 8, is to provide sufficient radial force by the strap-like springs 265 so that the micro-ridges of metal on the surfaces of a collet and contactor, when these units are pressed together, are deformed and form a nearly complete, although very small and minute contact area. This minute contact region thereby forms the principal resistive contact between the collet and the contactor. As the electrical heating current through the contactor and collet is increased from a very low value to a higher value, the temperature rise of these minute contact regions rises rather slowly. In the case of steel, as the current is increased such that the voltage drop across the contact reaches a level of about 0.3 volt (see voltmeter 270, FIG. 9), the temperature rise of the minute contact regions becomes markedly greater; above 0.3 volt that current increase rapidly approaches 500° C., the temperature at which spot welding will occur. Once welded, it may be difficult or even impossible to move contactor 252A without damaging the cable container, sleeve 247C, or other components of the system. The curve of this phenomenon is shown in FIG. 10.

Since the force required to move collet 228C up and down (see FIG. 7) is roughly proportional to the radial force exerted by the spring straps 265 of contactor 252A on collet 228C (FIG. 8), it is desirable to reduce the radial force to a point where acceptable downward or upward movements of forces are possible. Such forces, typically for the well shown in FIG. 7, would be of the order of 3,000 lbs. Therefore, for the 3,000 lbs. of force needed to move the collet 228C, the voltage drop at full current across the collet and contactor, as illustrated in FIG. 9, should not exceed 0.3 volt for the maximum current, which typically would not exceed about 1,000 amperes and is more probably at a value of about 400 amperes (ammeter 271, FIG. 9).

Excessive current density near the tip ends of the heating electrode or electrodes, in an electrical heating system, can lead to accelerated galvanic corrosion. While such corrosion can be largely mitigated by cathodic protection, or by the use of corrosion-resistant metals such as silicon steel, further mitigation may be needed. In the case of a slotted or apertured electrode constructed of steel, such as the electrode 28 of FIG. 1, a small segment of which is shown in greatly enlarged detail in FIG. 11A, precise, well-defined slots or apertures 29 in the steel pipe are needed to prevent influx of sand while allowing reasonable ingress of oil or other fluid. In any of the metal electrodes, the electrons accumulate near the edges or corners of the slots 29 as indicated at 30 in FIG. 11A. In so doing, they create excess charge and current densities at these points. As a consequence, the precisely defined geometry of the sharp edges of each slot or aperture 29 is eroded away, as is seen by comparing FIGS. 11A and 11B. Thus, the sharp slot corners 82 of FIG. 11A become the eroded corners 83 of FIG. 11B. Eventually, the apertures become enlarged. This erosion of the precisely defined geometry of the sharp edges of the slots 29 defeats the main purpose of the slots; with erosion, the electrode slots or apertures no longer prevent ingress of unwanted particulates and sand.

Figure 12:
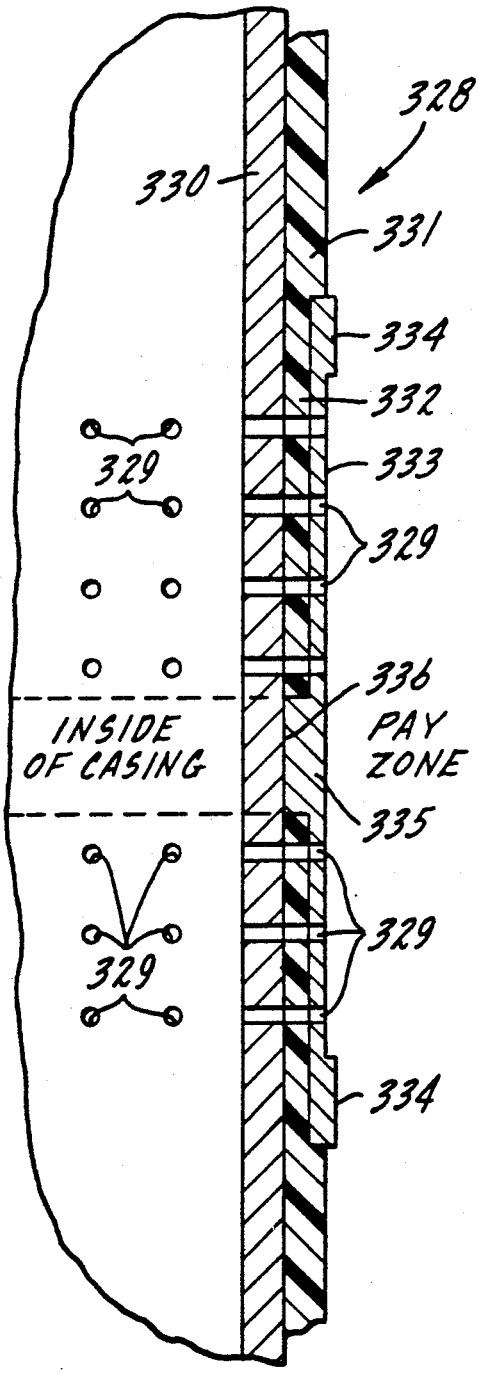
FIG. 12 is a detail sectional view of an electrode construction comprising a feature of the present invention.

In a cased borehole completion, as in well 20 of FIG. 1, a construction such as shown in FIG. 12 may be employed to mitigate galvanic erosion of the metal heating electrode, especially near the tips of the electrode. In FIG. 12, the right-hand side of the heating electrode 328 is outside of the casing; the left-hand side of FIG. 12 is the interior of the casing. The casing is a metal pipe 330, usually steel. As before, there are a multiplicity of slots or apertures 329 through the metal pipe 330; only a limited number of the apertures 329 are shown in FIG. 12. A high temperature fiber-reinforced insulation pipe or coating 331 is on the outside of the casing, as discussed previously and illustrated in FIG. 3 as item 151A. Thus, the outside part of the steel casing or tubing 330 of FIG. 12 is not exposed to the deposit; in this respect it is different from the electrodes of FIGS. 1 and 3. But the conductive metal pipe 330 of electrode 328 is coated by the layer 331 of high temperature insulation throughout its outside surface area, except for a small portion 336 near the center of electrode 328 which provides a metallic connection from the casing 330 to the center part 335 of a metal shell 333, a part of electrode 328 which does face the "pay zone". The upper and lower rim portions of this metal shell 333 are further thickened, as shown at 334, to mitigate the possible effects of corrosion, particularly galvanic corrosion.

The advantage of this construction is that should the tips or rim portions 334 of the electrode shell 333 be excessively corroded away, the principal production casing 330 is not damaged. The only disadvantage is that the length of the exposed electrode is progressively shortened, but this is not a major disadvantage and only results in a slight loss of the total enhanced production rate. Of course, the slots/apertures 329 must go through all of the layers 330, 332 and 333 of electrode 328 to admit oil into the interior of the well.

In addition to reinforcing the rims 334 of the active, exposed conductive electrode shell 333, it may also be desirable to treat the tip or rim of any ground electrode (not shown) in a fashion similar to that shown in FIG. 12, except that slots are avoided, the ohmic connection to the main casing is made several meters above the bottom of the casing, and the outer shell extends down to the bottom of the casing, where it abuts the fiber-reinforced high temperature insulation.

Figure 13:
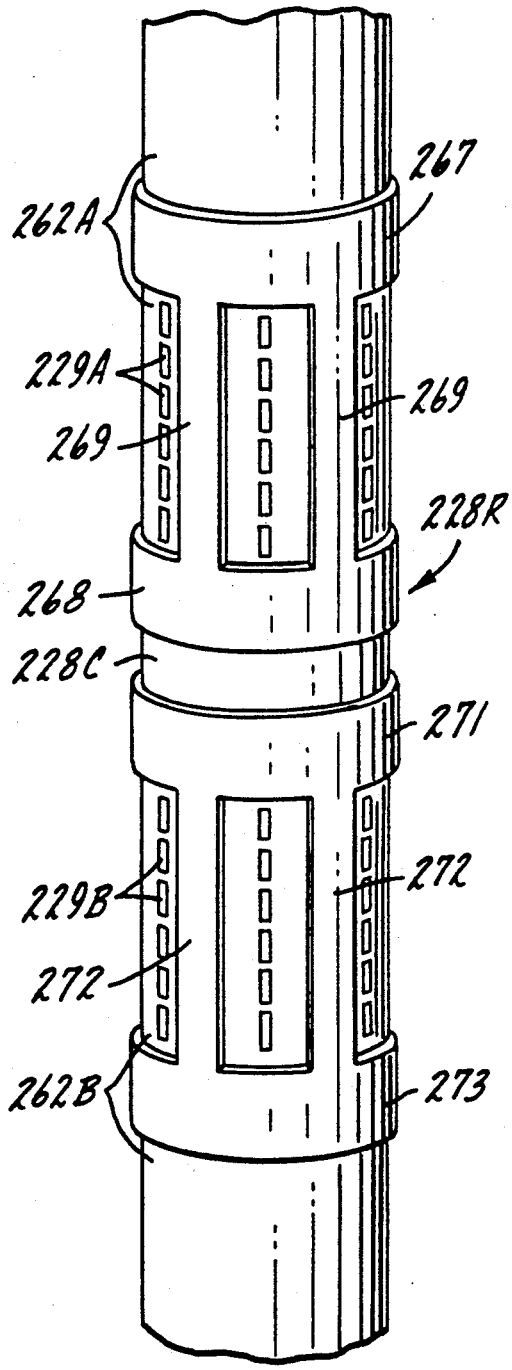
FIG. 13 is a perspective view of another electrode construction comprising a feature of the invention.

In an "open hole" well completion, as part of the upper and lower electrode assembly comprising electrodes 228A and 228B and collet 228C (FIG. 7), the electrode construction 228R illustrated in FIG. 13 may be employed. In this instance, the fiber-reinforced plastic pipe liner 262A, 262B is slotted along vertical lines in the active electrode regions, as shown at 229A and 229B, instead of using the round holes of FIG. 7. The upper portion of the active electrode in FIG. 13 is formed by a thickened metal hoop 267 which is connected to a lower metal hoop 268, adjacent to the collet electrode portion 228C, by a plurality of conductive vertical straps 269. The arrangement of the straps 269 is such that relatively large windows are formed; within these windows the appropriate slots 229A appear in the fiber-reinforced plastic pipe 262A. Only a few of the slots 229A, 229B are shown; there would be many more of these slots. Indeed, there may be slots under the metal straps 269; it makes little or no difference.

Below the collet/contact portion 228C of the electrode 228R there is, another metal hoop 271. Hoop 271 is connected by conductive straps 272 to a thickened metallic hoop 273 at the bottom of electrode 328. The same slot arrangement is employed as in the upper part of the composite electrode 228R; see slots 229B. The possibility of electrolytic erosion of the slots 229A and 229B is avoided because they are formed in the non-metallic FRP pipes 262A and 262B; at the same time, electrode 228R performs in much the same manner as a completely conductive electrode. Some erosion of the metal bands 267, 268, 271 and 273, and the connector straps 269 and 272, is likely, but can be readily compensated, particularly by using relatively thick metal stock for these components.

Figure 14:
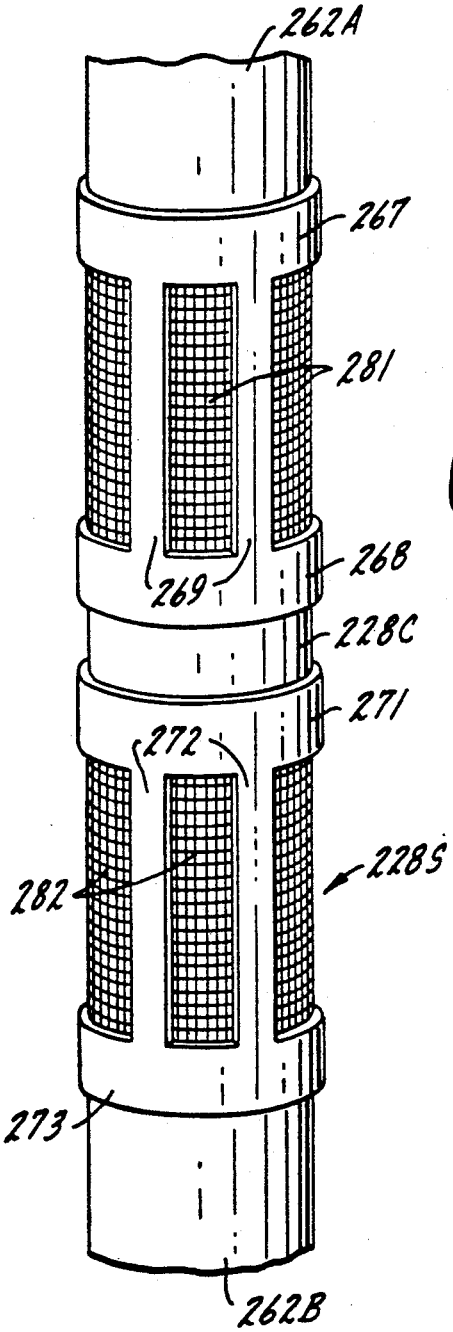
FIG. 14 is a perspective view, like FIG. 13, of yet another electrode construction according to the invention.

In some cases, when open hole completion is employed, metallic screens may be employed in the heating electrodes. Such screens cannot conduct electrical current with any acceptable efficiency, particularly with screens using small wire sizes, but the possibility of the thin wire screens becoming galvanically eroded must be considered. For downhole use, metal screens are not the best. In some cases, woven fiberglass screens may be employed. When non-conducting screens, usually reinforced plastic, are utilized, an arrangement similar to that of FIG. 13 can be employed, as illustrated by electrode 228S in FIG. 14. In this case the fiber-reinforced pipe in the region of the electrode, between the metal rings 267 and 268 and between metal bands 271 and 273, is replaced by woven, fiberglass reinforced plastic filaments 281 and 282 which have appropriate spacing. The spacers which hold the screens in place (not shown) are also made of non-conducting material. Other than the substitution of the fiberglass screens 281, 282, the construction shown in FIG. 14 is the same as in FIG. 13 and operation is essentially similar.

If metal wire screens are desired, they should be shielded by an outer set of closely spaced bars similar to those shown in FIG. 13, except that the spacing between the bars should be greatly reduced. In this instance the bars carry the bulk of the current and thereby protect the screen sections from electrolytic erosion. The appearance is similar to FIG. 14, but with the bars/straps 281 and 282 much closer to each other.

Figure 15:
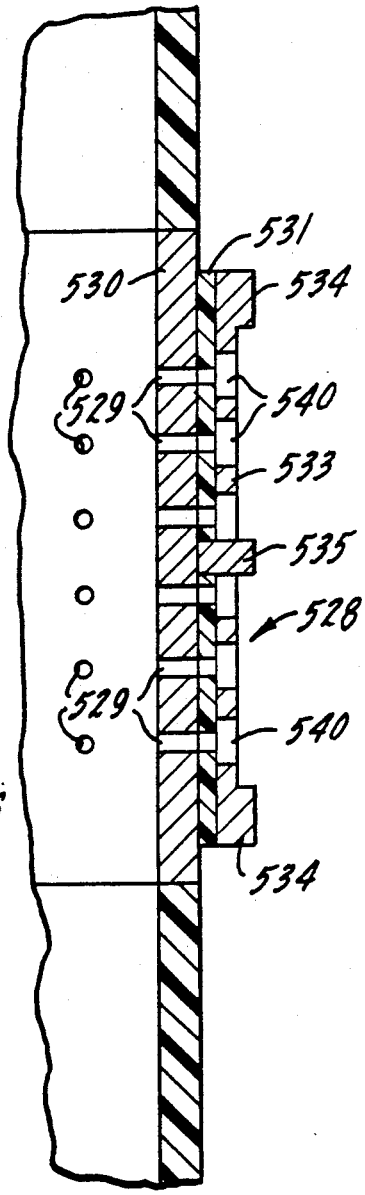
FIG. 15 is a detail sectional view, like FIG. 12, of an electrode construction according to another embodiment of the invention.

FIG. 15 illustrates another electrode construction 528, particularly for an open hole slotted liner system like FIG. 7; electrode 528 is essentially immune to slot degradation. It is a combination of the arrangements shown in FIGS. 12 and 13. In this case an inner steel electrode 530, a part of a production casing or liner, is covered by a cylindrical steel shell 533 which makes contact with the conductive inner casing at the center area 535. Large diameter holes 540 (e.g., 0.5 inch or 1.3 cm) are drilled through or otherwise formed in the outer shell 533 to expose the outer ends of appropriately cut slots 529, as illustrated in FIG. 15. As in the previously described electrode 328, electrode 528 of FIG. 15 has a high-temperature electrical isolation layer 531 between the conductive casing section 530 and the outer electrode shell 533. Apertures 529 extend through insulation 531. As before, the outer ends (rims) 534 of shell 533 are provided with additional metal to anticipate galvanic corrosion.

Figure 16:
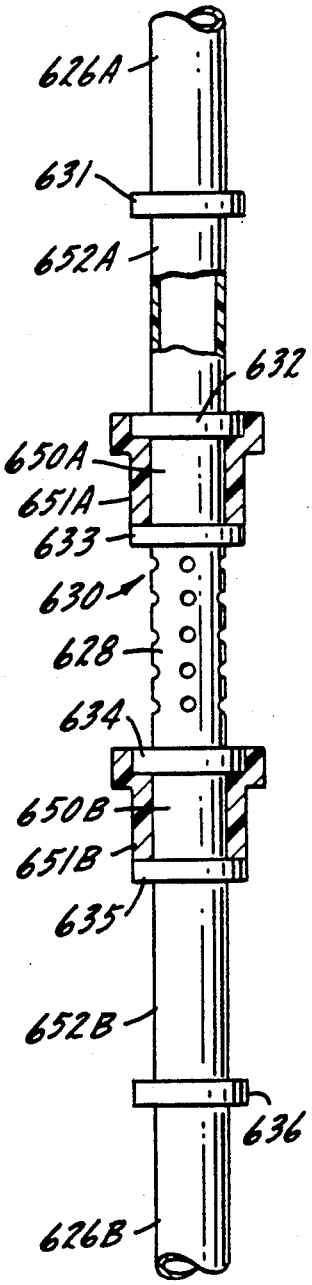
FIG. 16 illustrates a further electrode construction embodying features of the invention.

FIG. 16 illustrates a casing and main heating electrode assembly 630 that can be used in the heating system of FIG. 1. Assembly 630, starting at the top, includes a section 626A of seven inch (178 mm) carbon steel casing, LT&C ST&C, positioned pin down; section 626A is the lowermost section in a string of steel pipe that extends up to the top of the well (not shown). Casing section 626A terminates in a conventional 178 mm LT&C casing coupling 631 that joins casing section 626A to the top of a fiberglass casing section 652A. Section 652A is of LT&C Pin×Pin fiberglass, and has an outside diameter of 178 mm (7 inches), an inside diameter of 153.2 mm (6 inches), and a drift of 150.1 mm. Casing section 652A may typically have a tensile strength of 356,000N, and a burst strength and collapse strength of 13.7 MPs; the length of the fiberglass section 652A may typically be ten meters.

Next, continuing downwardly, is a coupling 632 and a relatively short (three meters) casing section 650A of 7 inch (178 mm) pipe, with members 632 and 650A both bearing a coating 651A of an electrical and thermal isolator material. A typical thickness for the coating 651A is about 12 mm. A coupling 633 joins casing segment 650A to the top of heating electrode 628, which has a height dependent upon the extent of the pay zone for the well. Continuing downwardly, the FIG. 16 assembly 630 includes another coupling 634, and a short (three meters) steel casing segment 650B; both have an external isolator coating 651B. Segments 650A and 650B are alike, as are coatings 651A and 651B. The casing segments are both of 178 mm (7 inches) OD steel, 34.23 KG/m, LT&C construction. The remaining elements of the assembly, a coupling 635, insulator casing 652B (FRP pipe), another coupling 636, and lower casing 626B, duplicate the upper part of the assembly.

In any of the electrical heating systems for mineral wells described above, it may be necessary or desirable to locate one or more thermal sensors downhole of the well to guard against unusual and potentially damaging high temperature rises. Thermal sensors (thermo couples) and their requisite electrical circuits are well known and hence have not been shown in the drawings. However, they should be utilized, particularly in any circumstance in which flow of the well may be interrupted for even relatively short periods of time, because these wells still depend upon convection due to movement of the oil to the surface to avoid excessive heating conditions. Stated differently, the electrical heating systems of the invention ought to be shut down at any time when the flow of oil is interrupted because there is then an appreciable likelihood of overheating.

The electrical heating systems of the invention are robust and long lasting, yet afford appreciable improvements in efficiency of heating in mineral wells, whether utilized for reservoir stimulation or for heating well components such as the production tubing. Excessive parasitic power dissipation is precluded, particularly in the annulus between the production and the tubing in a cased hole and in the annulus between the pump rod and the production tubing. Other parasitic power losses between the main electrode and adjacent conductive portions of the well casing are also held to a minimum. The heating electrodes, insulators, and other components of the heating systems of the invention are utilized with equal benefit in wells having grounded or hot wellheads. Possible adverse effects of galvanic corrosion are effectively limited or minimized; the systems of the invention afford downhole electrical heating electrodes that preclude ingress of sand without undue inhibition of fluid inflow and that endure, as required for downhole use. The heating system components can be utilized in conjunction with known conventional well drilling and well completion apparatus.

We claim:

1. An electrical heating system for a mineral well, such as an oil well, comprising:

a conductive metal casing of given diameter D1 disposed as a liner within a well bore that extends into the earth through a pay zone containing the desired mineral liquid, the casing comprising two sections separated by a gap within the pay zone;

a production tubing of given diameter D2, such that $D2<D1$, extending longitudinally through the casing in spaced relation thereto;

a multi-perforate heating electrode, comprising a cylinder having a diameter of about D1, positioned in the gap in the pay zone as a part of the casing, one end rim of the electrode being disposed inwardly of the pay zone by a distance of at least about 3D1 from the corresponding outer limit of the pay zone;

two non-conductive isolator cylinders, each having a diameter of about D1, each isolator cylinder mechanically connecting the electrode to the casing to afford a complete casing structure through the pay zone portion of the well bore;

and electrical power connection means for applying electrical power to the electrode.

2. An electrical heating system for a mineral well, according to claim 1, in which each rim of the electrode is disposed inwardly of the pay zone by a distance of at least about 3D1 from the corresponding outer limit of the pay zone.

3. An electrical heating system for a mineral liquid well, according to claim 1, in which the electrical power connection means comprises:

an electrical power cable extending down into the casing, the lower end of the power cable being electrically connected to a conductive downhole portion of the production tubing that extends through the pay zone;

and an electrical contactor interconnecting the downhole portion of the production tubing to the electrode, in the level of the pay zone.

4. An electrical heating system for a mineral well, according to claim 3, in which the electrical cable is an armored cable with the armor formed of a non-magnetic material.

5. An electrical heating system for a mineral well, according to claim 4, in which the material for the electrical cable armor is monel metal.

6. An electrical heating system for a mineral well, according to claim 1, in which the electrical power connection means comprises an armored electrical power cable extending down through the casing in parallel with the production tubing, the armor on the cable constituting a non-magnetic material.

7. An electrical heating system for a mineral well, according to claim 6, in which the non-magnetic material for the cable armor is monel metal.

8. An electrical heating system for a mineral well, according to claim 1, and further comprising an annular member of high-temperature insulation effectively extending beyond said one end rim of the electrode for a height of at least one meter to minimize electrical and thermal dissipation.

9. An electrical heating system for a mineral well, according to claim 1, and further comprising two elongated annular members of high-temperature insulation, one effectively extending below the electrode and the other effectively extending above the electrode, to minimize electrical and thermal dissipation.

10. An electrical heating system for a mineral well, according to claim 9, in which each annular member is a self-supporting insulator cylinder having a height of at least one meter.

11. An electrical heating system for a mineral well, according to claim 10, in which the height of each insulator cylinder is at least three meters.

12. An electrical heating system for a mineral well, according to claim 9, in which each annular member is an insulator layer mounted on and supported by a conductive pipe, each such layer having a height of at least one meter.

13. An electrical heating system for a mineral well, according to claim 12, in which the height of each annular member is at least three meters.

14. An electrical heating system for a mineral well, according to claim 9, in which the upper annular member has a height sufficient so that no more than ten percent of the electrical power in the heating system is dissipated in the annulus between the heating electrode and the upper portion of the casing, above the pay zone.

15. An electrical heating system for a mineral well, according to claim 9, in which the lower annular member has a height sufficient so that no more than ten percent of the electrical power in the heating system is dissipated in the annulus between the heating electrode and the lower section of the casing, below the pay zone.

16. An electrical heating system for a mineral well, according to claim 3, and further comprising:

a non-conductive tubular isolator member, having a diameter of about D2, interposed in the production tubing to isolate an upper portion of the production tubing electrically and thermally from the downhole portion of the production tubing extending through the pay zone, to which the electrical power cable is connected.

17. An electrical heating system for a mineral well, according to claim 16, in which the downhole portion of the production tubing, extending into the top of the pay zone, has a water-impermeable non-conductive coating for a height of at least five meters.

18. An electrical heating system for a mineral well, according to claim 16, in which the tubular isolator member in the production tubing has a height of at least three meters.

19. An electrical heating system for a mineral well, according to claim 16, in which the tubular isolator member in the production tubing has a height sufficient so that no more than ten percent of the electrical power in the heating system is dissipated in the production tubing.

20. An electrical heating system for a mineral well, according to claim 3, in which the electrical connection to the production tubing is located immediately above the top of the pay zone so that the system operates to heat the pay zone around the well without appreciable heating of the upper portion of the well.

21. An electrical heating system for a mineral well, according to claim 3, in which the electrical connection to the production tubing is located several hundred meters above the top of the pay zone so as to afford appreciable heating of the production tubing above the pay zone.

22. An electrical heating system for a mineral well, according to claim 1, in which the heating electrode is a heating electrode assembly comprising:

a cylindrical conductive first electrode member having at least a limited number of apertures therethrough;

a cylindrical insulator second electrode member, disposed within the first electrode member and including a multiplicity of perforations therethrough, at least some of the perforations in the insulator member being aligned with the apertures in the conductive first electrode member to permit ingress of fluid from the pay zone of the well to the interior of the cylindrical insulator member; and electrical contactor means, extending from the conductive first electrode member through the insulator member to the interior of the insulator member, for applying electrical power to the conductive electrode member.

23. An electrical heating system for a mineral well, according to claim 22, in which the conductive first electrode member has upper and lower rims substantially thicker than other parts of the first electrode member to compensate for galvanic erosion.

24. An electrical heating system for a mineral well, according to claim 22, in which the electrode assembly further comprises:

a cylindrical conductive third electrode member, positioned within and supporting the second electrode member, the third electrode member having a plurality of apertures aligned with perforations in the second electrode member to allow ingress of fluid into the interior of the third electrode member;

and electrical connector means between the conductive first and third electrode members.

25. An electrical heating system for a mineral well, such as an oil well, comprising:

a well bore that extends into the earth through a pay zone containing the desired mineral liquid;

a liner suspended within a downhole portion of the well bore, the liner extending from a location above the pay zone to a location at least as low as the bottom of the pay zone, the liner being formed principally of a fiber reinforced non-conductive pipe having a diameter D5;

a multi-perforate heating electrode of cylindrical configuration, having a diameter of about D5, positioned in and forming a part of the liner, in the pay zone, one conductive end rim of the electrode being disposed inwardly of the pay zone by a distance of at least about 3D5 from the corresponding outer limit of the pay zone;

and electrical power connection means for applying electrical power to the electrode.

26. An electrical heating system for a mineral well, according to claim 25, in which each end rim of the electrode is conductive, and is disposed inwardly of the pay zone by a distance of at least about 3D5 from the corresponding outer limit of the pay zone.

27. An electrical heating system for a mineral liquid well, according to claim 26, in which the electrical power connection means comprises:

an electrical power cable extending down into the well bore, the lowermost end of the power cable being electrically connected to a conductive electrical contactor;

the electrical contactor connecting the power cable to the electrode, in the level of the pay zone.

28. An electrical heating system for a mineral well, according to claim 27, in which the upper part of the electrical cable, above the pay zone, is an armored cable with the armor formed of a non-magnetic material.

29. An electrical heating system for a mineral well, according to claim 28, in which the material for the electrical cable armor is monel metal.

30. An electrical heating system for a mineral well, according to claim 27, in which the lower part of the power cable, immediately above the electrical contactor, is enclosed within electrical insulator cable container means that also suspends and supports the electrical contactor in the pay zone.

31. An electrical heating system for a mineral well, according to claim 30, in which the cable container means comprises a length of fiber-reinforced plastic pipe having an O.D. substantially smaller than D5.

32. An electrical heating system for a mineral well, according to claim 25, in which the electrical power connection means comprises an upper power cable formed by an armored electrical power cable extending down through the well bore to a level above the pay zone, the armor on the cable constituting a non-magnetic material, and a lower power cable formed by an unarmored cable, enclosed within an electrical insulator pipe, connecting the upper cable to an electrical contactor that engages the electrode.

33. An electrical heating system for a mineral well, according to claim 32, in which the electrical insulator pipe supports the electrical contactor in the pay zone.

34. An electrical heating system for a mineral well, according to claim 25, in which the fiber reinforced non-conductive pipe of the liner affords high-temperature insulation, effectively extending beyond said one conductive end rim of the electrode for a height of at least three meters to minimize electrical and thermal dissipation.

35. An electrical heating system for a mineral well, according to claim 23, in which the fiber reinforced non-conductive pipe of the liner is in two section, each of which affords high-temperature insulation, one section effectively extending at least three meters below one conductive end rim of electrode and the other section effectively extending at least three meters above the other conductive end rim of the electrode, to minimize electrical and thermal dissipation.

36. An electrical heating system for a mineral well, according to claim 35, in which each end rim of the electrode is conductive, and is disposed inwardly of the pay zone by a distance of at least about 3D5 from the corresponding outer limit of the pay zone.

37. An electrical heating system for a mineral well, according to claim 25, in which the heating electrode is a heating electrode assembly comprising:

a cylindrical conductive first electrode member having at least a limited number of apertures therethrough;

a cylindrical insulator second electrode member, disposed within the first electrode member and including a multiplicity of perforations therethrough, at least some of the perforations in the insulator member being aligned with the apertures in the conductive first electrode member to permit ingress of fluid from the pay zone of the well to the interior of the cylindrical insulator member; and electrical contactor means, extending from the conductive first electrode member through the insulator member to the interior of the insulator member, for applying electrical power to the conductive electrode member.

38. An electrical heating system for a mineral well, according to claim 23, in which the conductive first electrode member has upper and lower rims substantially thicker than other parts of the first electrode member to compensate for galvanic erosion.

39. An electrical heating system for a mineral well, according to claim 37, in which the electrode assembly further comprises:

a cylindrical conductive third electrode member, positioned within and supporting the second electrode member, the third electrode member having a plurality of apertures aligned with perforations in the second electrode member to allow ingress of fluid into the interior of the third electrode member;

and electrical connector means between the conductive first and third electrode members.

40. A downhole heating electrode assembly for an electrical heating system in a mineral well, such as an oil well, comprising:

a cylindrical conductive first electrode member positioned within the mineral well in a pay zone, the first electrode member having at least a limited number of apertures therethrough;

a cylindrical insulator second electrode member, disposed within the first electrode member and including a multiplicity of perforations therethrough, at least some of the perforations in the insulator member being aligned with the apertures in the conductive first electrode member to permit ingress of fluid from the pay zone of the well to the interior of the cylindrical insulator member; and electrical contactor means, extending from the conductive first electrode member through the insulator member to the interior of the insulator member, for applying electrical power to the conductive electrode member.

41. A downhole heating electrode assembly for a mineral well such as an oil well, according to claim 40, in which the conductive first electrode member has upper and lower rims substantially thicker than other parts of the first electrode member to compensate for galvanic erosion.

42. A downhole heating electrode assembly for a mineral well such as an oil well, according to claim 40, in which the apertures in the conductive first electrode member are much larger than the perforations in the insulating second electrode member.

43. A downhole heating electrode assembly for a mineral well such as an oil well, according to claim 42, in which there are a multiplicity of the perforations in the second electrode member aligned with each of the apertures in the first electrode member.

44. A downhole heating electrode assembly for a mineral well such as an oil well, according to claim 40, and further comprising:

a cylindrical conductive third electrode member, positioned within and supporting the second electrode member, the third electrode member having a plurality of apertures aligned with perforations in the second electrode member to allow ingress of fluid into the interior of the third electrode member;

and electrical connector means between the conductive first and third electrode members.

45. A downhole heating electrode assembly for a mineral well such as an oil well, according to claim 44, in which the apertures in the conductive first electrode member are much larger than the perforations in the insulating second electrode member.

46. A downhole heating electrode assembly for a mineral well such as an oil well, according to claim 45, in which there are a multiplicity of the perforations in the second electrode member aligned with each of the apertures in the first electrode member.

47. A downhole heating electrode assembly for a mineral well such as an oil well, according to claim 44, in which the apertures in the conductive third electrode member are perforations of about the same size as the perforations in the insulating second electrode member and the two sets of perforations are aligned one-for-one with each other.

48. A downhole heating electrode assembly for a mineral well such as an oil well, according to claim 47, in which the apertures in the conductive first electrode member are much larger than the perforations in the insulating second electrode member.

49. A downhole heating electrode assembly for a mineral well such as an oil well, according to claim 48, in which there are a multiplicity of the perforations in the second electrode member aligned with each of the apertures in the first electrode member.

50. A downhole heating electrode assembly for a mineral well such as an oil well, according to claim 40, in which the apertures in the conductive first electrode member are aligned one-for-one with the perforations in the insulating second electrode member.

51. A downhole heating electrode assembly for a mineral well such as an oil well, according to claim 50, in which the apertures in the conductive first electrode member are appreciably larger than the perforations in the insulating second electrode member.

52. A downhole heating electrode assembly for a mineral well such as an oil well, according to claim 50, in which the apertures in the conductive first electrode member are about the same size as the perforations in the insulating second electrode member.

* * * * *